US005123582A

United States Patent [19]

Lo

[11] Patent Number: 5,123,582

[45] Date of Patent: Jun. 23, 1992

[54] CONNECTIVE TAPE STAND

[76] Inventor: Paul Lo, 2 Fl., No. 12-1, Lane 12, Min Te Street, Pan Chiao City, Taipei County, Taiwan

[21] Appl. No.: 618,628

[22] Filed: Nov. 27, 1990

[51] Int. Cl.[5] ..... B26F 3/02; B65D 85/672

[52] U.S. Cl. ..... 225/25; 225/38; 225/42; 225/47

[58] Field of Search ..... 225/25, 26, 34, 38, 225/42, 47

[56] References Cited

U.S. PATENT DOCUMENTS

| | | | |
|---|---|---|---|
| 3,373,865 | 3/1968 | Hollins | 225/47 X |
| 3,502,252 | 3/1970 | Mariani | 225/38 X |
| 3,743,151 | 7/1973 | Malcolm | 225/47 |
| 3,972,459 | 8/1976 | Cooper | 225/47 |
| 4,252,258 | 2/1981 | Plummer, III | 225/47 X |
| 4,262,835 | 4/1981 | Wrobel | 225/47 X |
| 4,527,722 | 7/1985 | Strachan | 225/34 X |
| 4,627,560 | 12/1986 | Samuelson | 225/25 X |

*Primary Examiner*—Frank T. Yost
*Assistant Examiner*—Rinaldi Rada
*Attorney, Agent, or Firm*—Morton J. Rosenberg; David I. Klein

[57] ABSTRACT

A connective tape stand which is characterized by a ring tenon and a ring mortise separately provided on the outside of two side walls of the tape stand. A plurality of single-unit tape stands may be connected one another by engaging their ring tenons and ring mortises with corresponding ring mortises and ring tenons on adjoining tape stand. With a series of connected tape stands, tapes of diverse colors and patterns may be conveniently provided for the users to choose freely. The connective tape stand is also characterized by two flanges extended from the rear half circumference of two tape support rings inside the side walls to an adequate width. With these extended flanges, tape reel mounted thereon may be more steadily held without slipping off the tape support rings when the tape is pulled.

2 Claims, 5 Drawing Sheets

CONNECTIVE TAPE STAND

BACKGROUND OF THE INVENTION

Most of the existing tape stands are of single-unit in their basic design. As shown in FIG. 5, a commonly used mini-type tape stand can hold a reel of tape for use easily. However, it is found in the gift package that tapes with different colors and patterns are always needed to match diverse wrappings. Sometimes, a single package would need more than one type of tape simultaneously to fix and decorate it. Under this tendency, users usually have to prepare several tape stands to pack a parcel satisfactorily. However, it is inevitable to cause disorder and inconvenience to use several single-unit tape stands at one time. Apart from the inconvenience as mentioned above, there is still another drawback existed in conventional tape stands. As shown in FIG. 6, the tape stand usually has a space reserved between two of its ring holder to facilitate the mounting of tape reel; but this space would easily cause the tape reel to drop off from the ring holders if the user pull the tape without properly pressing the two side walls of the tape stand.

SUMMARY OF THE INVENTION

It is the primary object of the invention to provide a connective tape stand, particularly to provide a tape stand on which a ring mortise and a ring tenon are separately formed at the outside of its two side walls; the tape stand may be connected to other similar ones by engaging their corresponding ring mortises or ring tenons. By this way, a plurality of tape stands may be connected to hold tapes of different colors and patterns for users to use freely at one time.

It is still another object of the invention to provide a tape stand on which two ring holders are provided with their rear portions projecting inwardly toward each other to form two flanges. With these two flanges, the tape reel thereon may be more steadily held without being pulled out of the ring holders easily.

BRIEF DESCRIPTION OF THE DRAWINGS

The invention can be easily understood by referring to the following description and the accompanying drawings wherein.

DETAILED DESCRIPTION OF THE PREFERRED EMBODIMENT

Figure 1:
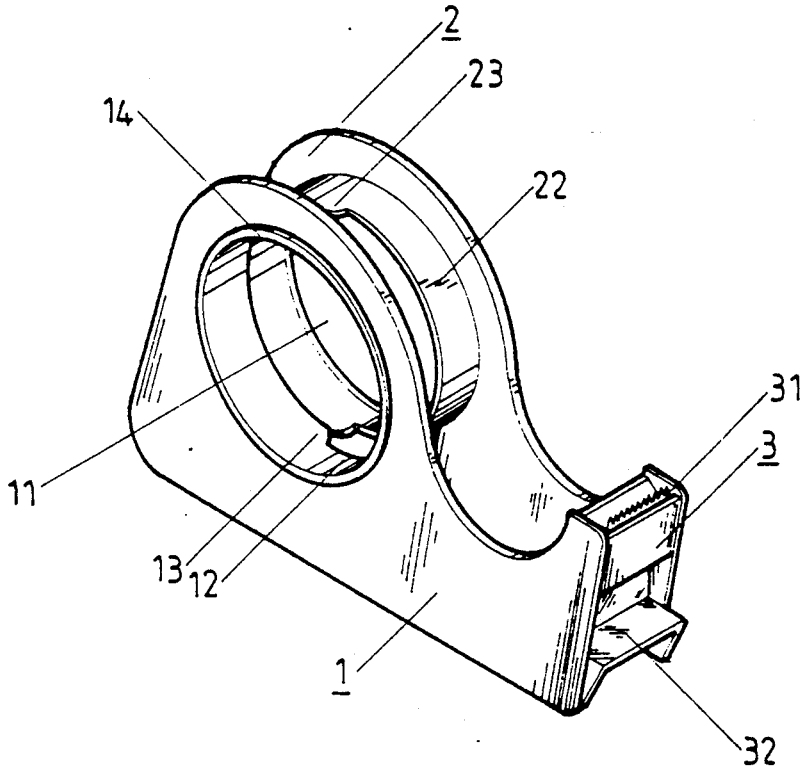
FIG. 1 is a perspective view showing the appearance of the invention.
Figure 2:
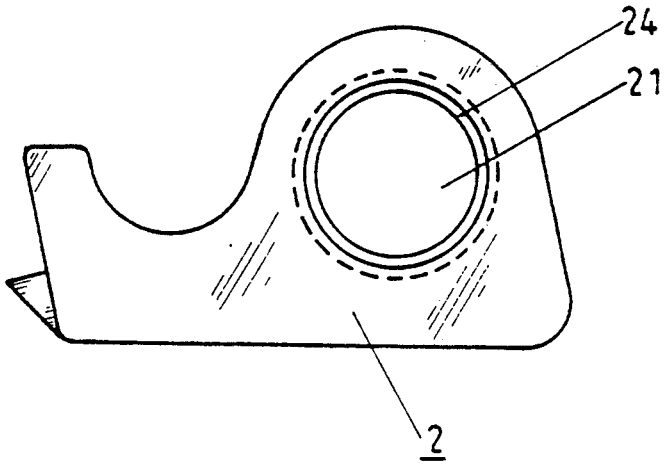
FIG. 2 is the side view of FIG. 1.

Please refer to FIG. 1. The connective tape stand of the present invention mainly includes two side walls 1, 2, and a glue-fixed member 3 which is clamped between the front ends of side walls 1, 2.

The side walls 1, 2 are generally flat sheets with a straight bottom line and a curved top lines to form a figure having a downward recess at the front and an upward bulge at the rear portion. Through holes 11, 21 are separately formed on the rear portion of side walls 1, 2. Inside circumferences of the through holes 11, 21 project toward each other to form tape support rings 12, 22. The rear half circumferences of tape support rings 12, 22 further extend to form two flanges 13, 23 so that the total width of the tape support rings 12, 22 plus the flanges 13, 23 after the two side walls 1, 2 are joined shall be equal to the width of the glue-fixed member 3.

A ring tenon 14 is further provided at the outside of the side wall 1 while a ring mortise 24 is provided at the outside of the side wall 2. The position and size of the ring tenon 14 and the ring mortise 24 are mutually corresponded so that any one of the present invention may be connected to other ones by engaging its ring tenon 14 with the ring mortise 24 on the adjoining tape stand, vice versa.

The glue-fixed member 3 is clamped and fixed by glue between the side walls 1, 2 at their front ends while a serrated member 31 is provided on its top for cutting tape 4. A plate 32 forwardly projects from an adequate position below the serrated member 31 to facilitate pivot lifting and lowering of the whole tape stand when necessary.

Figure 3:
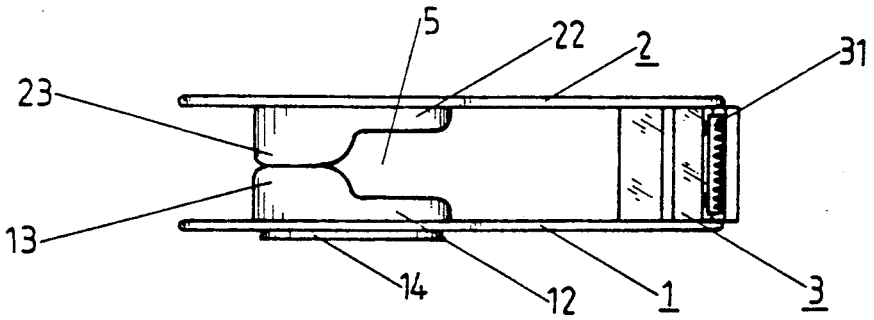
FIG. 3 is the top view of FIG. 1.
Figure 6:
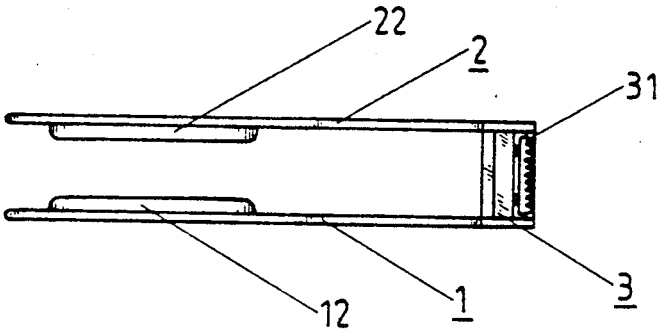
FIG 6 PRIOR ART
FIG. 6 is the top view of FIG. 5.

Tape reel 4 is positioned on the tape support rings 12, 22 by properly spliting the rear ends of side walls 1, 2. Since the side walls 1, 2 are made of somewhat flexible material, and only the front end of the tape stand is glue-fixed, the side walls 1, 2 can be easily split enought for mounting a reel of tape therein. Please further refer to FIG. 3, in which, it can be seen that the flanges 13, 23 extended from the rear portion of the tape support rings 12, 22 are only formed at the rear half circumferences of the support rings 12, 22, and an adequate space 5 is reserved between the tape support rings 12, 22 at their front ends. With this space 5, a tape reel can be mounted easier without splitting the side walls 1, 2 too much. For the purpose to provide a wider support to hold the tape reel more steadily, the flanges 13, 23 may extend to the extent that they are about to contact each other. When comparing with conventional tape stand as shown in FIG. 6 in which a rather big space is allowed between the tape support rings 12, 22, the present invention obviously eliminates the previous disadvantage that a tape reel is easy to slip off from the tape support rings while it provides an easier way to mount the tape reel.

Figure 4:
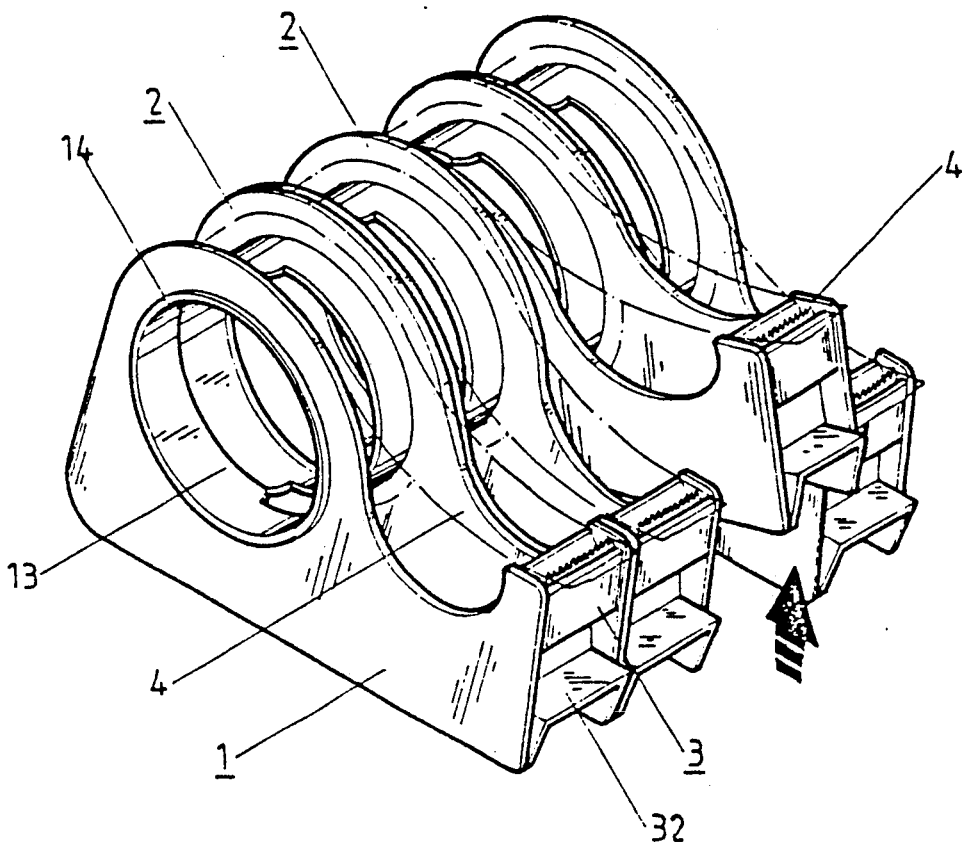
FIG. 4 illustrates a preferred embodiment of the invention in which several connective tape stands are connected.
Figure 5:
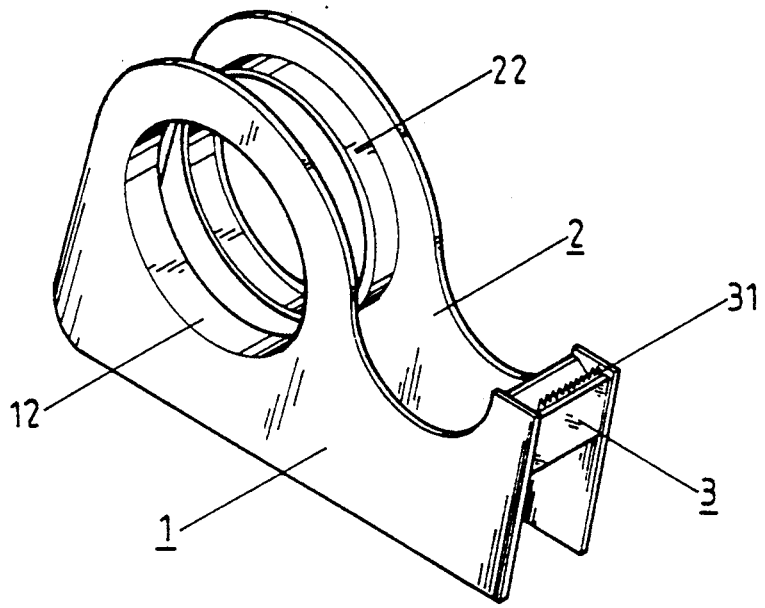
FIG 5 PRIOR ART
FIG. 5 shows a conventional tape stand.

Now refer to FIG. 4 wherein four tape stands of the present invention are connected one by one by engaging the ring tenon 14 and ring mortise 24 on one tape stand with the corresponding ring mortise 24 and ring tenon 14 on the adjoining tape stands. Each of the connected tape stands is pivotly turnable upward or downward in relative to one another. When use of a certain tape stand among these connected tape stands is desirable, the user may simply lift the desired tape stand by using the plate 32 as shown in FIG. 4. By this way, the desired tape may be pulled and used more conveniently.

The present invention is particularly suitable for mounting color tapes. With tapes of different colors and patterns mounted on a series of connected tape stands, the user may select the desired tape in a most convenient manner. It is natural that tapes of different widths can also be mounted on such connective tape stands to provide diverse choices for users.

I claim:

1. A tape dispenser comprising:

a pair of parallel, longitudinally extending side wall members, each of said side wall members having a linear bottom surface and an upper surface having an asymmetric S-contour;

a transversely directed plate member secured to a first end of each said sidewall members for fixedly securing said side wall members to each other in spaced relation, said spaced apart side wall members defining a cavity for insert of a tape reel therein, each of said side wall members having a through opening in aligned relation, said openings formed through a portion of said side wall members adjacent a second end of said side wall members longitudinally opposite said first end of said side wall members;

a pair of aligned support rings secured to respective side wall members extending internal said cavity, said support rings having an internal diameter substantially equal to a diameter of each of said through openings in said side wall members defining a first transversely displaced front end of said support rings and a second contiguously interfaced rear end of said support rings, said transversely directed plate member having a serrated tape cutting member formed on a top section thereof;

one of said side wall members having a ring tenon surrounding a respective through opening, said ring tenon extending external said cavity;

the other of said side wall members having a ring mortise surrounding a respective through opening for mating engagement with a respective ring tenon of a second tape dispenser; and, said side wall members being flexibly displaceable in a direction transverse to said longitudinally extending side wall members for insert of said tape reel on said support rings.

2. The tape dispenser as recited in claim 1 including a lifting plate member secured to said transversely directed plate member on a bottom section thereof, said lifting plate member extending out of plane with respect to said transversely directed plate member and external said cavity.

* * * * *